United States Patent [19]

Pierson et al.

[11] Patent Number: 5,048,581

[45] Date of Patent: Sep. 17, 1991

[54] VENEER TENDERIZER APPARATUS AND PROCESS

[75] Inventors: Darrell E. Pierson, Federal Way; Edward L. Snellgrove, Tacoma, both of Wash.

[73] Assignee: Weyerhaeuser Company, Tacoma, Wash.

[21] Appl. No.: 518,185

[22] Filed: May 3, 1990

[51] Int. Cl.[5] ..... B27M 1/02

[52] U.S. Cl. ..... 144/362; 83/867; 100/121; 144/2 J

[58] Field of Search ..... 83/867; 144/2 R, 2 J, 144/2 K, 362; 100/121, 176

[56] References Cited

U.S. PATENT DOCUMENTS

| | | | |
|---|---|---|---|
| 839,680 | 12/1906 | Voight | 144/362 |
| 1,363,593 | 12/1920 | Hewitt | 144/2 J |
| 2,202,110 | 5/1940 | Maurer | 144/2 J |
| 4,137,956 | 2/1979 | Toberg | 144/2 J |
| 4,655,866 | 4/1987 | Tellman et al. | 144/2 J |
| 4,691,629 | 9/1987 | Koba | 144/362 |
| 4,790,360 | 12/1988 | Clarke et al. | 144/2 J |
| 4,836,254 | 6/1989 | Ruddick | 144/362 |
| 4,858,660 | 8/1989 | Toberg | 144/362 |

FOREIGN PATENT DOCUMENTS

| | | | |
|---|---|---|---|
| 2025314 | 1/1980 | United Kingdom | 144/362 |

*Primary Examiner*—W. Donald Bray
*Attorney, Agent, or Firm*—Jensen & Puntigam

[57] ABSTRACT

The veneer tenderizer includes upper and lower tenderizer rollers (12, 14) with the veneer sheet (10) being fed with the grain oriented parallel with the rollers (12, 14). Each roller (12, 14) comprises a plurality of successive, set-apart cutter blades (16) with each blade having a plurality of cutter teeth (18) evenly spaced around the periphery thereof. The cutter blades (16) on each roller are arranged such that the cutter teeth (18) on each successive cutter blade (16) are angularly offset relative to the cutter teeth or adjacent cutter blades. The rollers (12, 14) are positioned such that the cutter blades (16) mounted on the lower roller (14) are interleaved with the cutter blades (16) on the upper roller (12).

9 Claims, 4 Drawing Sheets

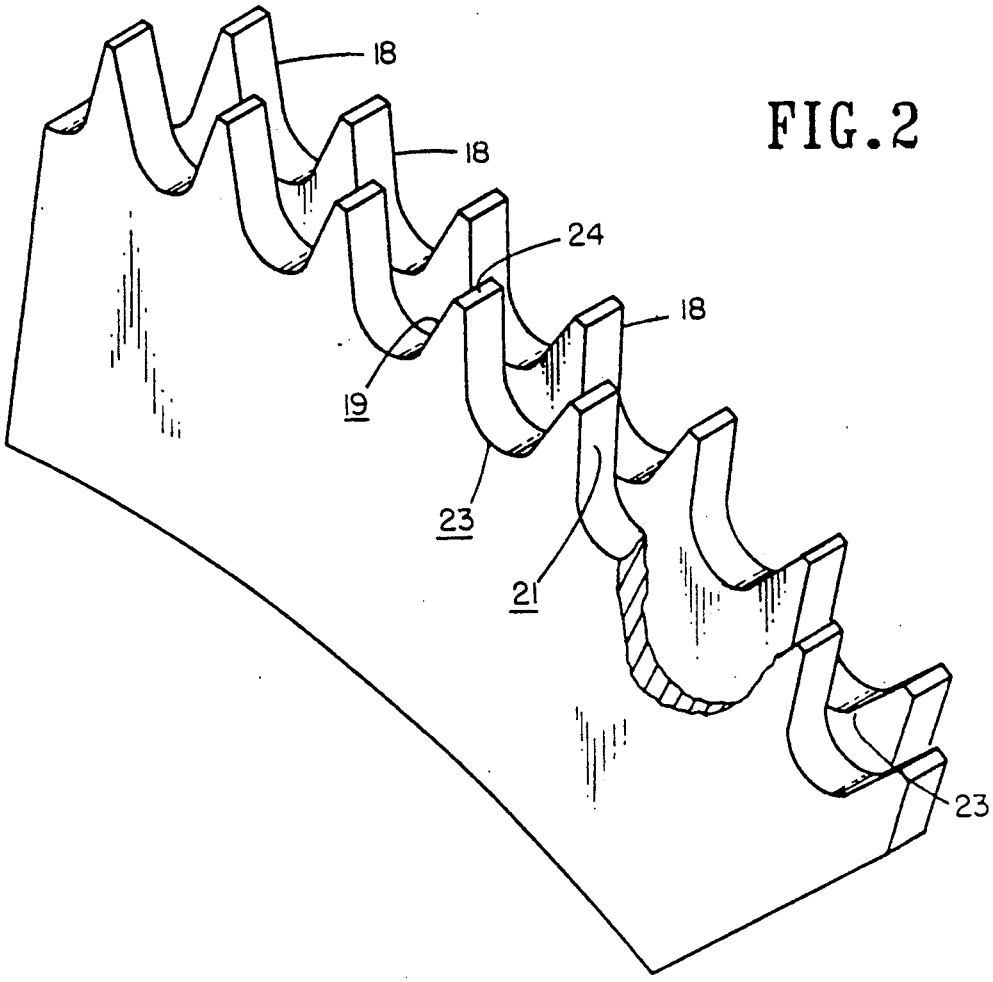
FIG.2
FIG.1
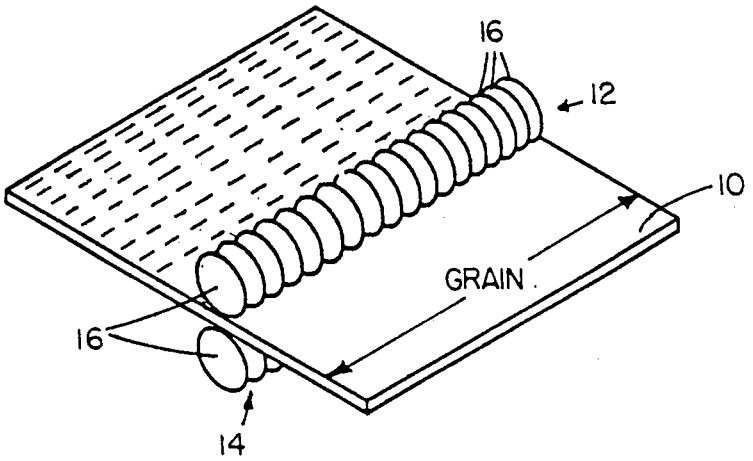

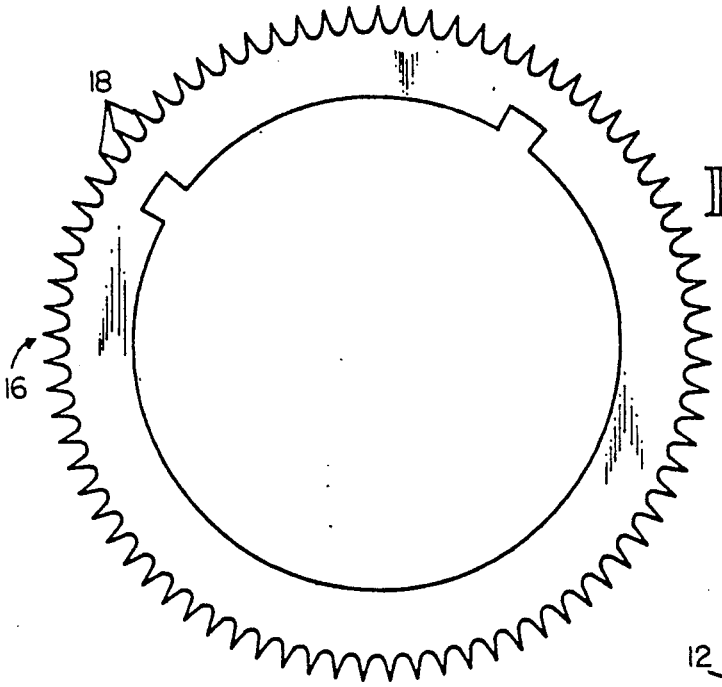
FIG.3
FIG.5
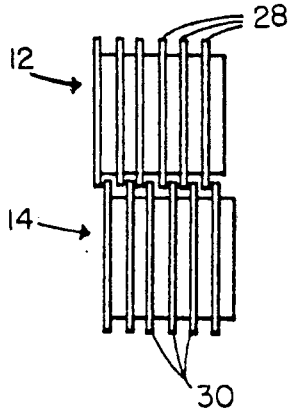
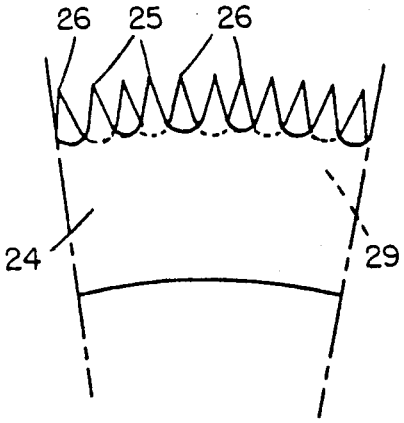
FIG.4
FIG.6
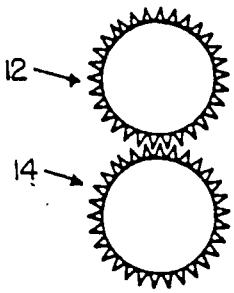
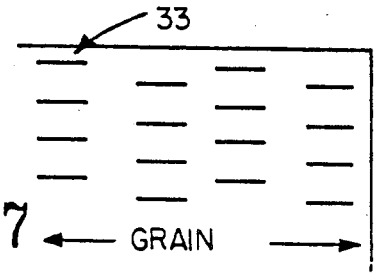
FIG.7

VENEER TENDERIZER APPARATUS AND PROCESS

TECHNICAL FIELD

The present invention relates generally to the art of veneer incising and more particularly concerns a specific apparatus and process for tenderizing veneer, particularly green veneer, so as to minimize curling and other distortion which occurs during drying of the veneer.

BACKGROUND ART

Multiple layers of thin veneers are used to form plywood. It is known that plywood can be made from a variety of different veneer species having varying strengths and densities. Typically, the veneer from a stronger species will be used for the individual face and back plies of the plywood, while other veneers, including weaker and/or lower grade veneers, are used for the inner plies. In the past, the individual veneer sheets, upon exit from the veneer dryer, would often be curled or otherwise distorted to some extent. This distortion of the veneer sheets which occurred during the drying process was due to various characteristics of the veneer wood itself. Sometimes the veneer would be curled so badly that it could not be used. To overcome this problem with respect to veneer used for inner plies, the veneer was incised at selected intervals by a plurality of knife-like blades, to "relax" the veneer from its curled state. When relaxed in this manner, the veneer could be readily flattened and used in plywood, and could even be edge glued.

Such incising of veneers, however, is accomplished following the drying step. With some veneer sheets, the curling of the veneer during drying becomes sufficiently extreme to "plug up" the dryer, necessitating a temporary shut-down of the dryer to remove the material and then a restart. This results in a loss of time and material in the veneer manufacturing process and decreases operator efficiency. When it became known that the veneer produced from near the center of a log was likely to result in the degree of curling during drying which would lead to interruption of dryer operation, the veneer peeling process was typically terminated for a particular log at that point, even though additional quality veneer could otherwise be obtained from the log.

As mentioned above, treatment of veneer to defeat curling and other distortions has in the past only been done following the drying step. It is known, however, to use incisor rollers on green veneer which are similar to those used to relax curled veneer, as shown in U.S. Pat. No. 4,655,8669 to Tellman et al, to laterally expand the veneer, thereby in effect increasing the size of the veneer sheet by some amount. This technique typically leads to significant savings in material. The use of incising to expand veneer, however, does lead to weakness in the veneer and resulting breakage, which are undesirable. These problems would tend to point away from the application of the Tellman teaching to green veneer for other purposes such as to minimize curling and distortion, where veneer strength is important.

DISCLOSURE OF THE INVENTION

Accordingly, the invention is an apparatus and process for tenderizing veneer, wherein the apparatus includes at least one tenderizing roller combination which comprises upper and lower tenderizing rollers. Each tenderizing roller includes a plurality of spaced-apart cutter blades, each cutter blade having a plurality of cutter teeth arranged around the periphery thereof. The rollers are spaced relative to each other such that the blades on the upper and lower rollers are interleaved. In operation, the cutter teeth of the blades of the upper and lower rollers produce cuts in both the upper and lower surfaces of the veneer.

In the process, the upper and lower surfaces of the veneer sheet are punctured by cutter blades mounted on cooperating upper and lower tenderizing rollers, producing a pattern of punctures in the veneer sheet such as to relax the veneer sheet without substantially expanding the size thereof.

BRIEF DESCRIPTION OF THE DRAWINGS

FIG. 1 is a simplified isometric view showing the veneer tenderizer apparatus of the present invention in operation on a section of green veneer.

FIG. 2 is an isometric view of a portion of two adjacent blades on one tenderizer roller portion of the apparatus of FIG. 1.

FIG. 3 is an elevational view showing one cutter blade of a tenderizer roller portion of the apparatus of FIG. 1.

FIG. 4 is an elevational view showing the angular offset of two adjacent cutter blades on a tenderizer roller portion of the apparatus of FIG. 1.

FIG. 5 is an elevational view showing the interleaving of cutter blades for the upper and lower tenderizer rollers of the apparatus of FIG. 1.

FIG. 6 is a cross sectional view of the tenderizer rollers shown in FIG. 5.

FIG. 7 is a diagram showing a tenderizing pattern on a sheet of veneer using the cutter blade configuration of the present invention.

BEST MODE FOR CARRYING OUT THE INVENTION

Figure 8:
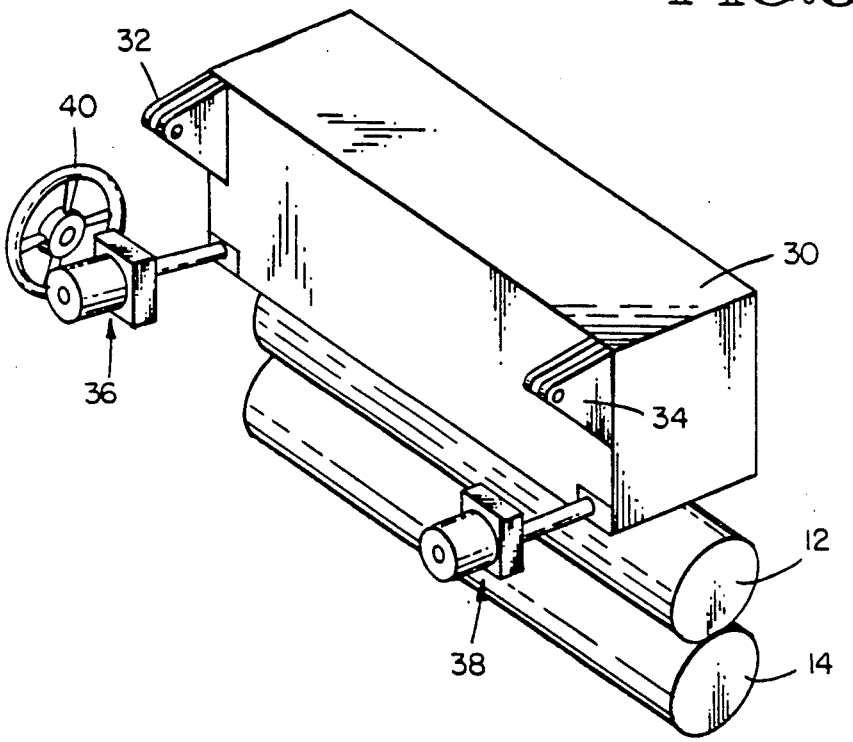
FIG. 8 is an isometric view showing the apparatus for adjusting the position of the upper (nip) tenderizer roller of the apparatus of FIG. 1.

FIG. 1 shows a simplified view of the veneer tenderizer apparatus of the present invention relative to a section of veneer.

A sheet of veneer 10 is shown with the grain thereof extending in the lateral direction as indicated, the sheet being fed longitudinally into the tenderizer apparatus 11. The tenderizer 11 generally includes a pair of tenderizer rollers 12 and 14, with roller 12 being a upper or nip roller, the position of which in the embodiment shown is adjustable, as discussed hereafter, while roller 14 is a lower, stationary roller. Each roller 12, 14 comprises a plurality of cutter blades 16. Referring to FIG. 3, each cutter blade 16 in the embodiment shown is circular, with an outside diameter of 8.5 inches and an inside diameter of 6.5 inches. Each blade is flat, approximately 0.13 inches thick. The rollers 12 and 14 extend laterally across the veneer sheet 10, parallel with the direction of the grain. In operation, the veneer sheet 10 is fed through the two rollers 12 and 14, resulting in a pattern of punctures in both sides of the veneer. Typically, the rollers 12, 14 are positioned vertically relative to each other so that the teeth 18 of the cutter blades penetrate the respective surfaces of the veneer sheet 10 for a distance of approximately half the thickness of the veneer. Although only one set of veneer rollers (12, 14) is shown in FIG. 1, it should be understood that additional sets of rollers may be provided downstream of rollers 12 and 14 if desired.

FIG. 2 shows in more detail the configuration of the teeth 18 of the cutter blades. In the embodiment shown, the teeth are approximately one quarter inch high; around the periphery of the cutter blade 16 are a total of 78 teeth so that the space between successive teeth is also one quarter inch. The side surfaces 19, 21 of each tooth 18 are straight, with an angle of within the range of 10°-30°, preferably 15°, from the vertical. The side surfaces of adjacent teeth are connected by a shallow curved portion 23. The rectangular top 24 of each tooth is approximately 0.13 inches long, i.e. the thickness of the blade, and approximately 1/32 inch wide, although the width could vary from very narrow to ¼ inch. Successive cutter blades on each roller are separated by spacing elements 27-27 which in the embodiment shown are 7½ inches in diameter, ¼ inch thick, and are made of steel. In the embodiment shown, each roller comprises a total of 276 cutter blades, separated by spacing elements. The number of cutter blades could be varied, i.e. from 250-325, for example.

Referring to FIG. 4, adjacent cutter blades for each roller are offset angularly from each other such that the teeth 25—25 of one cutter blade, i.e. cutter blade 24, in FIG. 4 are angularly intermediate of two adjacent teeth 26—26 on the next adjacent cutter blade 29. The next successive cutter blade (the one following blade 29) has the same angular orientation as cutter blade 24.

FIGS. 5 and 6 show the physical relationship of the cutter blades of the upper and lower rollers 12 and 14 in the apparatus of the present invention. The cutter blades 28—28 on upper roller 12 and the cutter blades 31—31 on roller 14 are spaced laterally so that adjacent cutter blades 28—28 are interleaved with adjacent cutter blades 31—31. The spacer elements on each roller are sufficiently thick that there still is some space laterally between the respective interleaved blades. Further, the rollers 12 and 14 are positioned vertically relative to each other such that there is a small overlap between the cutter blades 28—28 and 31—31 of the respective rollers 12 and 14 in the vertical plane. This overlapping relationship is shown most clearly in FIG. 6.

The result of the angular offset of successive blades on rollers 12 and 14 and the interleaved and overlapping arrangement of the blades on the rollers 12 and 14 produces a particular cut or puncture pattern on the veneer sheet 32 which is shown in FIG. 7. The pattern in FIG. 7 shows one surface 32 of the veneer sheet; the other side will have a similar pattern, but interleaved with the pattern shown in FIG. 7. The cuts are made with the grain of the veneer sheet 32, with each cut being approximately ⅛ inch long and with successive cuts in each row, i.e. row 33 in FIG. 7, being approximately ¼ inch apart. The distance between adjacent rows, i.e. the distance from the end of one cut by one blade to the beginning of an adjacent cut by the adjacent blade is ⅛ inch. The offset of the cuts between the adjacent rows is also ⅛ inch. It should be understood, however, that this pattern and/or the relative dimensions thereof, may be varied.

While knife-like incisor blades are utilized in the prior art to relax curled dry veneer, the arrangement of the cutter blades of the present invention, the configuration of the teeth on the cutter blades, and the interleaving of the cutter blades of the upper and lower rollers jointly produce what can best be described as a tenderizing effect on green veneer, since at the conclusion of the cutting/puncturing procedure, the veneer is typically in a relaxed state. The advantageous and somewhat surprising result of the tenderizing process is that during the follow-on drying process, the veneer maintains its relaxed state and does not curl or otherwise significantly distort.

The structure for adjusting the nip roller 12 is shown in FIG. 8. A cross beam support element 30 which rigidly supports the nip roller 12 is itself pivotally supported at points 32 and 34. Jacks 36 and 38 control the movement of the cross beam about pivot points 32 and 34. Adjusting wheel 40 controls the position of jacks 36 and 38. If rollers 12 and 14 are too close together, the adjusting wheel 40 is rotated so as to pivot cross beam 30 and the nip roller 12 in the one direction slightly away from the stationary roller 14. If it is desired to move the nip roller 12 closer to the stationary roller 14, adjusting wheel 40 is rotated so that the cross beam 30 and roller 12 rotate in the other direction. This results in the nip roller 12 coming closer to the stationary roller 14 through an arc of movement. At the lowest point of the arc, the two rollers 12 and 14 will be at their closest relative position.

Figure 9:
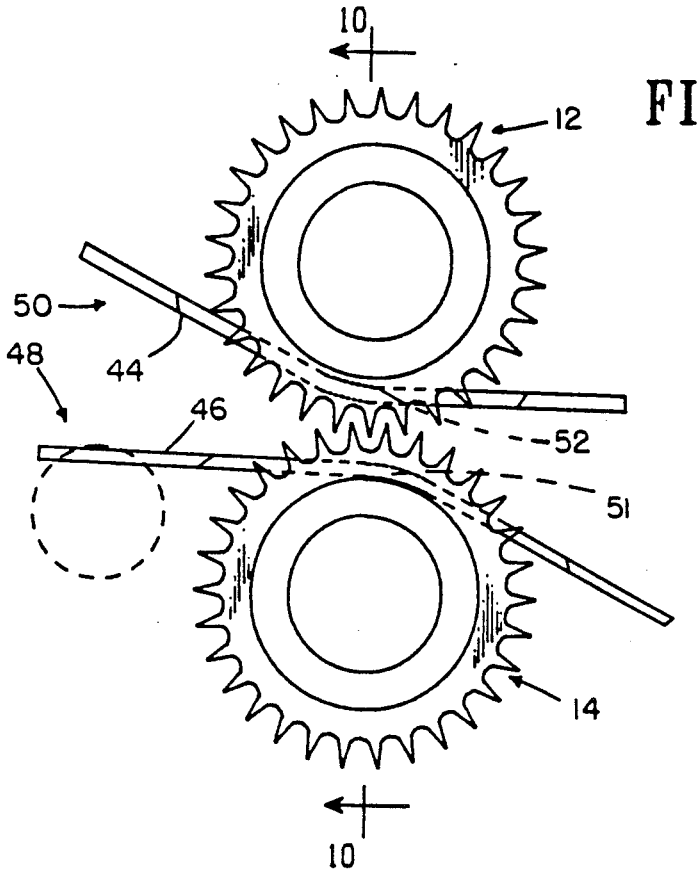
FIG. 9 is a cross sectional diagram showing the veneer stripper portion of the present invention.
Figure 10:
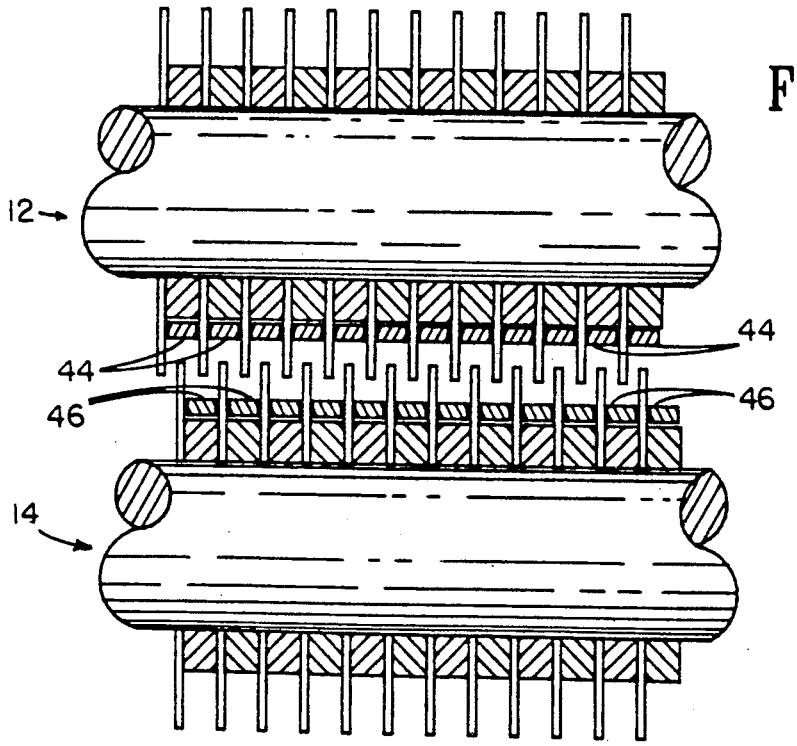
FIG. 10 is an elevational view of the veneer stripper of FIG. 9.

FIGS. 9 and 10 show another feature of the present invention, in particular, the combination of elements which insure that the veneer actually comes off of, i.e. free of, the respective cutter blades following the cutting action. This combination of elements, referred to as a veneer stripper assembly, includes two relatively thin sheet metal plates 44 and 46. The sheet metal plates extend the full length of the respective rollers and in the embodiment shown extend a short distance to the front and rear of the rollers 12 and 14. Sheet metal plate 44 is associated with upper roller 12, while sheet metal plate 46 is associated with lower roller 14. Plates 44 and 46 are slotted so that the individual cutter blades of the rollers can extend therethrough, with the plates 44 and 46 positioned so as to be adjacent, but not touching, the individual successive spacer elements, and close to the cutter blades. This arrangement is shown most clearly in FIG. 10.

FIG. 9 shows the configuration of plates 44 and 46 relative to their associated rollers. Plate 46 is relatively horizontal at the infeed side 48 of roller 14. The plate then angles slightly downwardly at the apex 51 of the roller, thereby following generally the shape of the roller for a short distance, and from that point angles downwardly approximately 30°, although this angle can be varied substantially, from the horizontal, extending for a distance from the outfeed side of the roller 14. Plate 44 at the infeed side 50 of roller 12 is angled approximately 30° upwardly from the horizontal, to the nadir 52 of roller 12, at which point it becomes horizontal and extends horizontally beyond the outfeed of roller 12 a selected distance.

The above-described arrangement has been found to be quite effective; when a veneer sheet (not shown) moves between the two rollers 12 and 14, the portions of plates 44 and 46 beyond the rollers tend to passively prevent the veneer sheet from adhering to the teeth on the cutter heads of both rollers, insuring a relatively smooth movement of the veneer through the rollers, without breakage of the veneer.

Hence, the present invention is a veneer tenderizer which is used to puncture green veneer prior to the drying thereof, in such a pattern and in such a manner that the veneer remains in a relaxed state during the drying process, so as to prevent plugging of the dryer. The rollers produce a particular pattern by means of a plurality of cutter blades on two rollers, each cutter blade having a number of teeth around the periphery thereof, with the teeth being offset and interleaved relative to other teeth on other cutter blades to produce the tenderizing effect.

Although a preferred embodiment of the invention has been disclosed for purposes of illustration, it should be understood that various modifications and changes may be incorporated in such embodiment without departing from the spirit of the invention, as defined by the claims which follow:

We claim:

1. An apparatus for tenderizing veneer, in which the grain thereof extends in a first direction, comprising;

at least one tenderizer roller combination comprising upper and lower tenderizing rollers, wherein the upper and lower tenderizing rollers each include a plurality of spaced-apart cutter blades, each cutter blade having a plurality of cutter teeth arranged around the periphery thereof, wherein each of the cutter teeth has a blunt tip, approximately within the range of 1/32 to ¼ inch wide, the cutter teeth thereby in operation producing indentations in the veneer without causing substantial expansion of the veneer, wherein the cutter blades are arranged on the rollers such that the cutter teeth on each blade are located approximately angularly midway between the cutter teeth of adjacent blades, wherein the rollers are spaced relative to each other such that the blades on the upper and lower rollers are interleaved and such that the cutter teeth of the blades of said upper and lower rollers, respectively, in operation penetrate the upper and lower surfaces of the veneer for approximately half the thickness of the veneer.

2. An apparatus of claim 1, wherein the cutter teeth on each cutter blade are approximately one quarter inch apart.

3. An apparatus of claim 1, wherein each cutter blade extends, respectively, in a cutter blade plane and wherein the cutter teeth on each cutter blade extend transversely to the cutter blade plane thereof.

4. An apparatus of claim 1, including means for feeding the veneer with the grain oriented parallel with the rollers and at a right angle to the plane of the cutter blades.

5. An apparatus of claim 1, including a plurality of roller combinations.

6. An apparatus of claim 1, including means for moving the upper and lower rollers toward and away from each other.

7. An apparatus of claim 1, including means associated with the upper and lower rollers to insure that the veneer comes free from the cutter blades following puncturing of the veneer, including upper and lower flat sheet members having slots therein and mounted relative to the upper and lower rollers so that the cutter blade teeth extend therethrough, wherein the lower sheet member is associated with the lower roller and is substantially horizontal at an infeed portion to the rollers and angles downwardly at an outfeed portion, and wherein the upper sheet member is associated with the upper roller and angles downwardly at the infeed portion to the roller and is horizontal at the outfeed portion.

8. A process for tenderizing veneer, having upper and lower surfaces, comprising the steps of:

puncturing both upper and lower surfaces of a veneer sheet with cutter blades mounted on cooperating upper and lower tenderizer rollers to produce a pattern of punctures in the veneer sheet, wherein the punctures in the lower surface are interleaved with the punctures in the upper surface, wherein the punctures in the upper and lower surfaces are arranged in such a manner that the punctures in each row thereof occur longitudinally between punctures of adjacent rows, and wherein the punctures extend into the veneer for approximately half the thickness of the veneer sheet and otherwise having such a configuration as to relax the veneer sheet without substantially expanding the size thereof.

9. A process of claim 8, wherein the cutter blades extend in a first direction and wherein the process includes the step of feeding the veneer with the grain thereof at a right angle to the plane of the first direction.

* * * * *